US012788056B2

(12) United States Patent
Mcgrath et al.

(10) Patent No.: US 12,788,056 B2
(45) Date of Patent: Nov. 10, 2026

(54) APPARATUS FOR AEROSOL GENERATING DEVICE

(71) Applicant: Nicoventures Trading Limited, London (GB)

(72) Inventors: Conor John Mcgrath, London (GB); Jonathan Neil Burgess, London (GB); Daniel Lochtman, London (GB); James Sheridan, London (GB); Jai-Ram Taank, London (GB); Michael David Thomas, London (GB); David William Bureau, London (GB)

(73) Assignee: Nicoventures Trading Limited, London (GB)

( * ) Notice: Subject to any disclaimer, the term of this patent is extended or adjusted under 35 U.S.C. 154(b) by 881 days.

(21) Appl. No.: 17/594,014

(22) PCT Filed: Apr. 3, 2020

(86) PCT No.: PCT/EP2020/059537
§ 371 (c)(1),
(2) Date: Sep. 30, 2021

(87) PCT Pub. No.: WO2020/201499
PCT Pub. Date: Oct. 8, 2020

(65) Prior Publication Data

US 2022/0192261 A1 Jun. 23, 2022

(30) Foreign Application Priority Data

Apr. 4, 2019 (GB) ..... 1904748

(51) Int. Cl.
*A24F 40/40* (2020.01)
*A24F 40/20* (2020.01)
(Continued)

(52) U.S. Cl.
CPC ..... *A24F 40/40* (2020.01); *A24F 40/20* (2020.01); *A24F 40/46* (2020.01); *A24F 40/465* (2020.01)

(58) Field of Classification Search
CPC ..... A24F 40/40; A24F 40/46
See application file for complete search history.

(56) References Cited

U.S. PATENT DOCUMENTS

2014/0332019 A1* 11/2014 Liu ..... A24F 40/50 392/404
2018/0027879 A1* 2/2018 Gavrielov ..... A24F 40/485
2021/0212366 A1* 7/2021 Paprocki ..... A24F 40/70

FOREIGN PATENT DOCUMENTS

JP 2016534730 A 11/2016
JP 2021557524 A 5/2023
(Continued)

OTHER PUBLICATIONS

"Decision to Grant received for Japanese Patent Application No. 2021-557524, mailed on Apr. 4, 2023", 5 pages (2 pages of English Translation and 3 pages of Official Copy).
(Continued)

*Primary Examiner* — Katherine A Will
(74) *Attorney, Agent, or Firm* — MERCHANT & GOULD P.C.

(57) ABSTRACT

An apparatus for an aerosol generating device comprises a first housing member for at least partly defining a chamber for containing a heater arrangement for heating an aerosol generating material; and a second housing member attached to the first housing member via an attachment. The first housing member and the second housing member define therebetween a passageway into the chamber. The passage-
(Continued)

way is configured to allow an electrical connecting member for connecting to the heater arrangement to extend through the passageway. The apparatus also comprises a sealing arrangement arranged to seal the passageway. The attachment between the first housing member and the second housing member is configured to hold the first housing member and the second housing member in a configuration which causes the sealing arrangement to seal the passageway.

12 Claims, 8 Drawing Sheets

(51) Int. Cl.
*A24F 40/46* (2020.01)
*A24F 40/465* (2020.01)

(56) References Cited

FOREIGN PATENT DOCUMENTS

| | | | | |
|---|---|---|---|---|
| WO | 2015062983 | A2 | 5/2015 | |
| WO | 2017194762 | A1 | 11/2017 | |
| WO | WO-2017/194766 | A1 * | 11/2017 | ..... A24B 15/167 |

OTHER PUBLICATIONS

"International Preliminary Report on Patentability received for PCT Patent Application No. PCT/EP2020/059537, mailed on Oct. 14, 2021", 10 pages.
"International Search Report and Written Opinion received for PCT Patent Application No. PCT/EP2020/059537, mailed on Aug. 11, 2020", 14 pages.
"Office Action received for Russian Patent Application No. 2021128807, mailed on Aug. 16, 2022", 3 Pages.
JP Office Action in Japanese Application No. 2023-076642, dated Jan. 21, 2025, 6 pages (with English translation).

* cited by examiner

APPARATUS FOR AEROSOL GENERATING DEVICE

PRIORITY CLAIM

The present application is a National Phase entry of PCT Application No. PCT/EP2020/059537, filed Apr. 3, 2020, which claims priority from Great Britain Application No. 1904748.9, filed Apr. 4, 2019, each of which is hereby fully incorporated herein by reference.

TECHNICAL FIELD

The present invention relates to apparatus for use with an aerosol generating device, wherein the aerosol generating device is for heating aerosolizable material to volatilize at least one component of the aerosolizable material.

BACKGROUND

Smoking articles, such as cigarettes, cigars and the like, burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

According to a first aspect of the present disclosure there is provided apparatus for an aerosol generating device, the apparatus comprising: a first housing member for at least partly defining a chamber for containing a heater arrangement for heating an aerosol generating material; a second housing member attached to the first housing member via an attachment, wherein the first housing member and the second housing member define therebetween a passageway into the chamber, and wherein the passageway is configured to allow an electrical connecting member for connecting to the heater arrangement to extend through the passageway; and a sealing arrangement arranged to seal the passageway; wherein the attachment between the first housing member and the second housing member is configured to hold the first housing member and the second housing member in a configuration which causes the sealing arrangement to seal the passageway.

The passageway may be located between a first end of the first housing member and a second end of the second housing member located adjacent the first end of the first housing member, and the attachment may attach the first end of the first housing member to the second end of the second housing member.

The attachment between the second housing member and the first housing member may be a releasable attachment and/or an attachment which is configurable to allow movement of the second housing member relative to the first housing member to unseal the passageway.

The attachment may comprise one or more threaded attachment members, such as one or more screws, or one or more nut and bolt pairs.

The one or more threaded attachment members may be tightened to a predetermined torque such that the sealing arrangement provides hermetic sealing of the passageway.

The sealing arrangement may comprise a first sealing member and a second sealing member; wherein the attachment between the first housing member and the second housing member is configured to hold the first and second sealing members in abutment with one another to hermetically seal the passageway between the first housing member and the second housing member and wherein the sealing arrangement is arranged in use to allow the electrical connecting member to extend through the passageway between the first sealing member and the second sealing member.

The attachment may be configured to provide a compressing force on the electrical connecting member located between the two sealing members to seal the passageway.

The sealing members may each comprise a surface which is configured to contact the electrical connecting member and which is configured to match a profile of a surface of the electrical connecting member. The surfaces of the sealing members may be substantially flat surfaces each configured to abut a substantially flat surface of the electrical connecting member.

One of the sealing members may comprise an aperture which is configured to allow the electrical connecting member to extend therethrough while the passageway is sealed to connect to the heater arrangement in the chamber.

The first housing member may define an elongate chamber for containing the heating arrangement, and the passageway may extend substantially perpendicularly to a longitudinal axis of the chamber.

The sealing arrangement may comprise at least one resilient sealing member.

The sealing arrangement may comprise at least one resilient member comprising silicone.

The sealing arrangement may comprise two resilient sealing members comprising silicone, for example the sealing arrangement may comprise two silicone gaskets.

The sealing arrangement may be configured to seal the passageway when a portion of the electrical connecting member shaped substantially as a sheet extends through the passageway.

According to a second aspect of the present disclosure there is provided apparatus for an aerosol generating device comprising: apparatus according to the first aspect of the present disclosure; a heater arrangement for being received in the chamber defined by first housing member; and an electrical connecting member for extending through the passageway into the chamber to connect to the heating arrangement.

According to a third aspect of the present disclosure there is provided an aerosol generating device comprising apparatus according to the first aspect of the present disclosure or apparatus according to the second aspect of the present disclosure.

According to a fourth aspect of the present disclosure there is provided a housing module for being received in an aerosol generating device, wherein the housing module is for containing a heater arrangement for heating aerosol generating material in the aerosol generating device, the housing module comprising: a housing at least partly defining a chamber for containing a heater arrangement for heating aerosol generating material to thereby generate an aerosol, wherein the housing comprises a proximal end and a distal end; and a passageway through the housing into the chamber, wherein the passageway is configured to allow an electrical connecting member for connecting to the heater arrangement to exit the chamber through the passageway; and wherein the passageway is located away from both the proximal end and the distal end of the housing.

The passageway may be oriented laterally to a longitudinal axis of the housing module extending between the proximal and the distal ends of the housing module.

The passageway may be oriented substantially perpendicularly to the longitudinal axis of the housing module.

The housing module may comprise a sealing arrangement arranged to seal the passageway while allowing the electrical connecting member through the passageway.

The housing module may comprise apparatus according to the first aspect of the present disclosure.

According to a fifth aspect of the present disclosure there is provided an aerosol generating device comprising: a housing module according to the fourth aspect of the present disclosure and a heating arrangement arranged in the chamber defined by the housing module; and an electrical connecting member extending through the passageway into the chamber such that a first portion of the electrical connecting member may connect to the heating arrangement; wherein a second portion of the electrical connecting member is exterior to the housing module and is arranged to connect to an electrical component of the device.

The electrical connecting member may exit the passageway in a direction lateral to a longitudinal axis of the housing module extending between the proximal and distal ends, and the second portion of the electrical connecting member may be aligned substantially parallel to the longitudinal axis of the housing module.

The second portion of the electrical connecting member may be configured to connect to an electrical component of the device, such as a printed circuit board, which is arranged adjacent to the housing module and substantially parallel with a longitudinal axis of the housing module.

The electrical connecting member may comprise only one bend between a portion of the electrical connecting member which exits the passageway in a direction lateral to the longitudinal axis of the housing module, and the second portion of the electrical connecting member which is aligned substantially parallel to the longitudinal axis of the housing module.

According to a sixth aspect of the present disclosure there is provided an aerosol generating system comprising: a device according to the third aspect of the present disclosure or a device according to a fifth aspect of the present disclosure; and an article containing an aerosol generating material arranged to be heated by the device.

The aerosol generating material may comprise tobacco and the device may be a tobacco heating product, also known as a heat not burn device.

Further features and advantages of the invention will become apparent from the following description of preferred embodiments of the invention, given by way of example only, which is made with reference to the accompanying drawings.

DETAILED DESCRIPTION OF THE DRAWINGS

As used herein, the term "aerosolizable material" includes materials that provide volatilized components upon heating, typically in the form of vapor or an aerosol. "Aerosolizable material" may be a non-tobacco-containing material or a tobacco-containing material. "Aerosolizable material" may, for example, include one or more of tobacco per se, tobacco derivatives, expanded tobacco, reconstituted tobacco, tobacco extract, homogenized tobacco or tobacco substitutes. The aerosolizable material can be in the form of ground tobacco, cut rag tobacco, extruded tobacco, reconstituted tobacco, reconstituted aerosolizable material, liquid, gel, amorphous solid, gelled sheet, powder, or agglomerates, or the like. "Aerosolizable material" also may include other, non-tobacco products, which, depending on the product, may or may not contain nicotine. "Aerosolizable material" may comprise one or more humectants, such as glycerol or propylene glycol. The term "aerosol generating material" may also be used herein interchangeably with the term "aerosolizable material".

As noted above, the aerosolizable material may comprise an "amorphous solid", which may alternatively be referred to as a "monolithic solid" (i.e. non-fibrous), or as a "dried gel". The amorphous solid is a solid material that may retain some fluid, such as liquid, within it. In some cases, the aerosolizable material comprises from about 50 wt %, 60 wt % or 70 wt % of amorphous solid, to about 90 wt %, 95 wt % or 100 wt % of amorphous solid. In some cases, the aerosolizable material consists of amorphous solid.

As used herein, the term "sheet" denotes an element having a width and length substantially greater than a thickness thereof. The sheet may be a strip, for example.

Certain examples of an aerosol generating devices described herein heat aerosol generating material by resistive heating. Resistive heating involves using electrically resistive heating elements that heat up when an electric current is applied to the electrically resistive heating element/s to heat the aerosol generating material.

Figure 1:
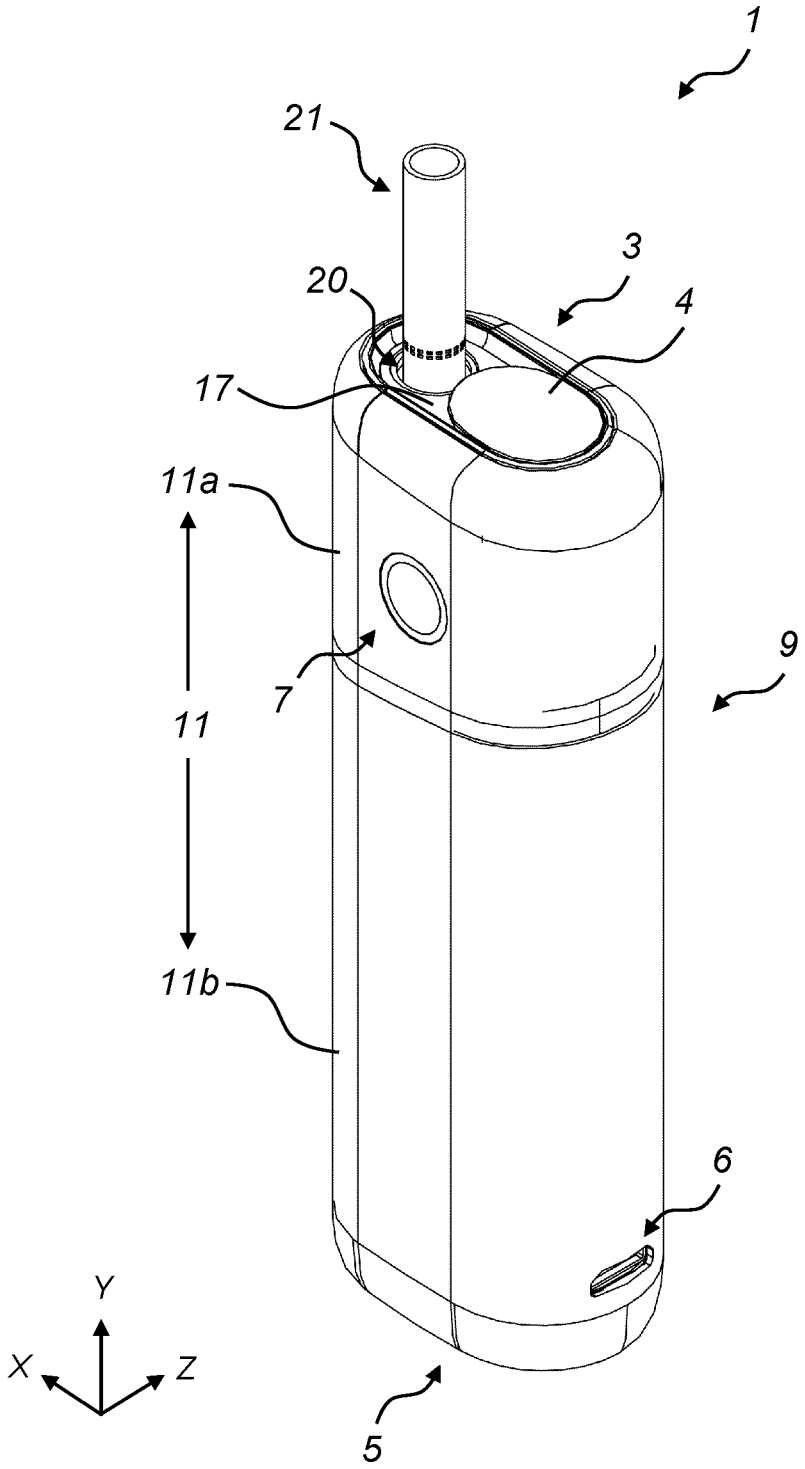
FIG. 1 shows a schematic perspective view of an example of an apparatus for heating aerosolizable material to volatilize at least one component of the aerosolizable material, also referred to herein as an aerosol generating device, wherein the apparatus is shown with an article comprising aerosolizable material inserted.

Referring to FIG. 1, there is shown a schematic perspective view of an apparatus 1, also referred to herein as an aerosol generating device 1, according to an example of the invention. The apparatus 1 is for heating aerosolizable material to volatilize at least one component of the aerosolizable material. In this example, the aerosolizable material comprises tobacco, and the apparatus 1 is a tobacco heating product (also known in the art as a tobacco heating device or a heat-not-burn device). The example apparatus 1 is a hand-held device.

The apparatus 1 comprises a first end 3 and a second end 5, opposite the first end 3. The first end 3 is sometimes referred to herein as the mouth end or proximal end of the apparatus 1. The second end 5 is sometimes referred to herein as the distal end of the apparatus 1. The apparatus 1 has an on/off button 7 to allow the apparatus 1, as a whole, to be switched on and off as desired by a user of the apparatus 1.

In broad outline, the apparatus 1 is configured to generate an aerosol to be inhaled by a user by heating an aerosol generating material. In use, a user inserts an article 21 into the apparatus 1 and activates the apparatus 1, e.g. using the button 7, to cause the apparatus 1 to begin heating the aerosol generating material. The user subsequently draws on the article 21 near the first end 3 of the apparatus 1 to inhale an aerosol generated by the apparatus 1. As a user draws on the article 21, generated aerosol flows through the apparatus 1 along a flow path towards the proximal end 3 of the apparatus 1.

In examples, a vapor is produced that then at least partly condenses to form an aerosol before exiting the apparatus 1 to be inhaled by the user.

In this respect, first it may be noted that, in general, a vapor is a substance in the gas phase at a temperature lower than its critical temperature, which means that for example the vapor can be condensed to a liquid by increasing its pressure without reducing the temperature. On the other hand, in general, an aerosol is a colloid of fine solid particles or liquid droplets, in air or another gas. A "colloid" is a substance in which microscopically dispersed insoluble particles are suspended throughout another substance.

For reasons of convenience, as used herein the term aerosol should be taken as meaning an aerosol, a vapor or a combination of an aerosol and vapor.

The apparatus 1 comprises a casing 9 for locating and protecting various internal components of the apparatus 1. The casing 9 is therefore an external housing for housing the internal components. In the example shown, the casing 9 comprises a sleeve 11 that encompass a perimeter of the apparatus 1, capped with a top panel 17, at the first end 3, which defines generally the 'top' of the apparatus 1 and a bottom panel 19, at the second end 5 (see FIGS. 2 to 5), which defines generally the 'bottom' of the apparatus 1.

The sleeve 11 comprises a first sleeve 11*a* and a second sleeve 11*b*. The first sleeve 11*a* is provided at a top portion of the apparatus 1 and extends away from the first end 3. The second sleeve 11*b* is provided at the bottom of the apparatus 1 and extends away from the second end 5. The first sleeve 11*a* and second sleeve 11*b* each encompass a perimeter of the apparatus 1. That is, the apparatus 1 comprises a longitudinal axis along a Y-direction, and the first sleeve 11*a* and the second sleeve 11*b* each surround the internal components in a direction radial to the longitudinal axis.

In this example, the first sleeve 11*a* and a second sleeve 11*b* are removably engaged with each other. In this example, the first sleeve 11*a* is engaged with the second sleeve 11*b* in a snap-fit arrangement comprising grooves and recesses.

In some examples, the top panel 17 and/or the bottom panel 19 may be removably fixed to the corresponding first and second sleeves 11*a*, 11*b*, respectively, to permit easy access to the interior of the apparatus 1. In some examples, the sleeve 11 may be "permanently" fixed to the top panel 17 and/or the bottom panel 19, for example to deter a user from accessing the interior of the apparatus 1. In one example, the panels 17 and 19 are made of a plastics material, including for example glass-filled nylon formed by injection molding, and the sleeve 11 is made of aluminum, though other materials and other manufacturing processes may be used.

The top panel 17 of the apparatus 1 has an opening 20 at the mouth end 3 of the apparatus 1 through which, in use, the article 21 containing aerosolizable material is inserted into the apparatus 1 and removed from the apparatus 1 by a user. The opening 20 in this example is opened and closed by a door 4. In the example shown, the door is movable between a closed position and an open position to allow for insertion of the article 21 into the apparatus 1. The door 4 is configured to move bi-directionally parallel to an X-direction.

Figure 3:
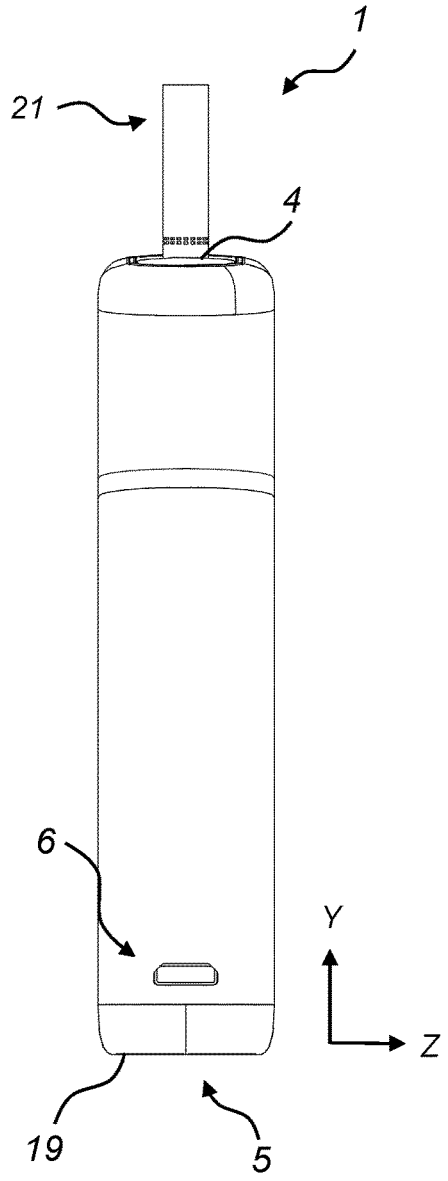
FIG. 3 shows a schematic right-side view of the example apparatus of FIG. 1 with the article inserted.

A connection port 6 is shown at the second end 5 of the apparatus 1. The connection port 6 is for connection to a cable and a power source for charging a power source of the apparatus 1. The connection port 6 extends in a Z-direction from a front side of the apparatus 1 to a rear side of the apparatus 1. As shown in FIG. 3, the connection port 6 is accessible on a right-side of the apparatus 1 at the second end 5 of the apparatus 1. Advantageously, the apparatus 1 may stand on the second end 5 whilst charging or data connection through the connection port 6. In the embodiment shown, the connection port 6 is a USB socket.

Figure 2:
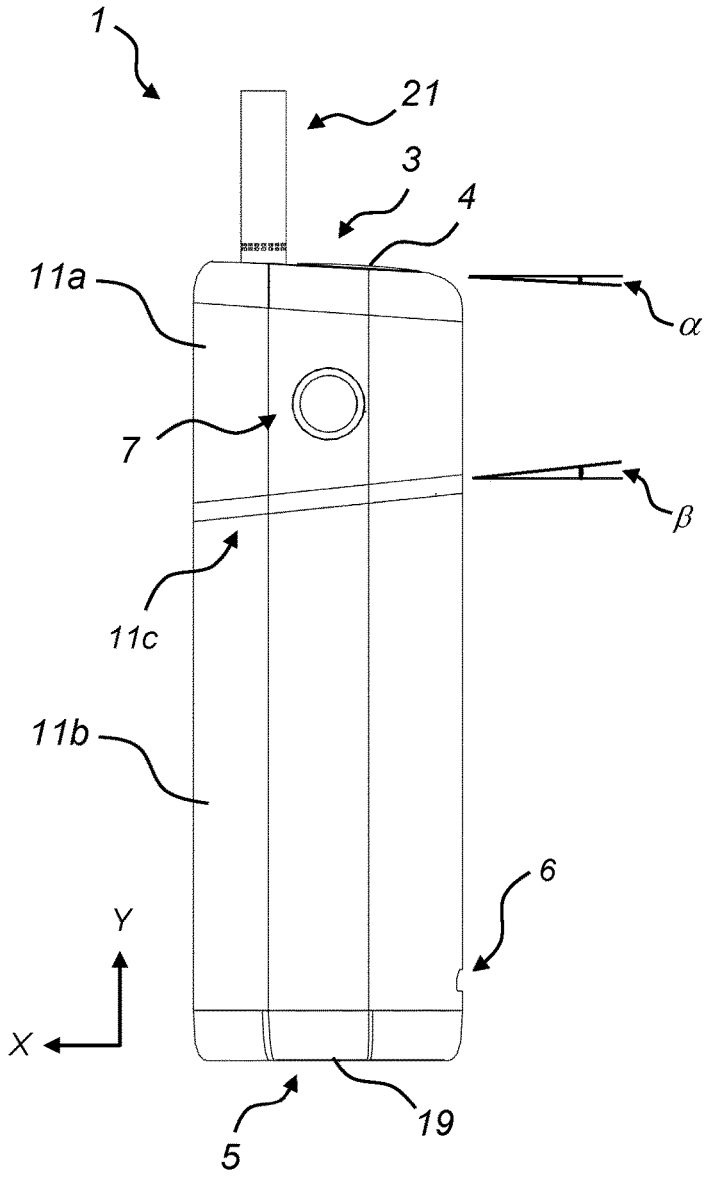
FIG. 2 shows a schematic front view of the example apparatus of FIG. 1 with the article inserted.

Referring to FIG. 2, the first sleeve 11*a* comprises a surface at the first end 3 of the apparatus 1 that is tapered. The tapered surface comprises a first angle $\alpha$ with respect to a surface of the second sleeve 11*b* at the second end 5. In this example, the surface of the second sleeve 11*b* at the second end 5 is substantially parallel to the X-direction. Therefore, as shown the article 21 is insertable through the opening 20 at a proximal portion of the first end 3. Where the first sleeve 11*a* and second sleeve 11*b* meet at a join 11*c*, a second angle $\beta$ with respect to the X-direction is formed. The second angle $\beta$ is shown to be greater than the first angle $\alpha$.

Figure 4:
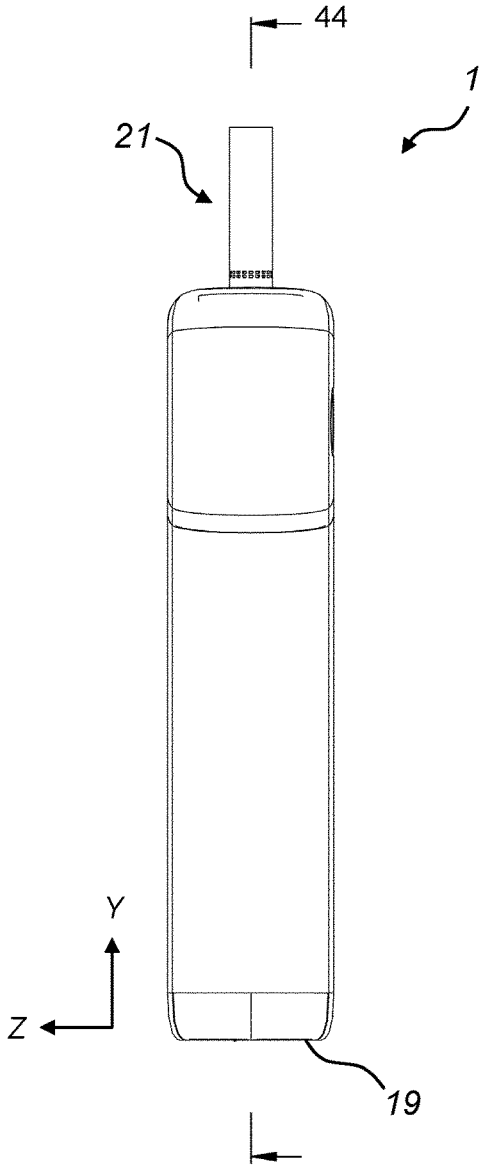
FIG. 4 shows a schematic left-side view of the example apparatus of FIG. 1 with the article inserted.

FIG. 3 and FIG. 4 respectively show a right-side and left-side of the apparatus 1. Here, the article 21 is shown in a laterally central location. This is because the opening 20 through which the article 21 is inserted is positioned at a mid-way point along the X-direction and Z-direction.

Figure 5:
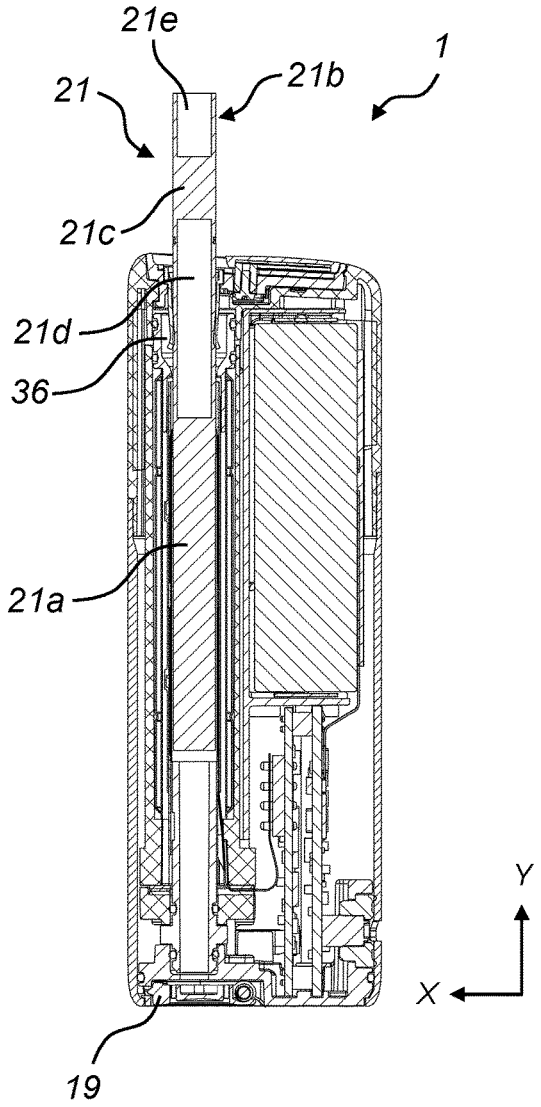
FIG. 5 shows a schematic front cross-sectional view of the example apparatus of FIG. 1 with the article inserted through line A-A shown in FIG. 4.
Figure 6:
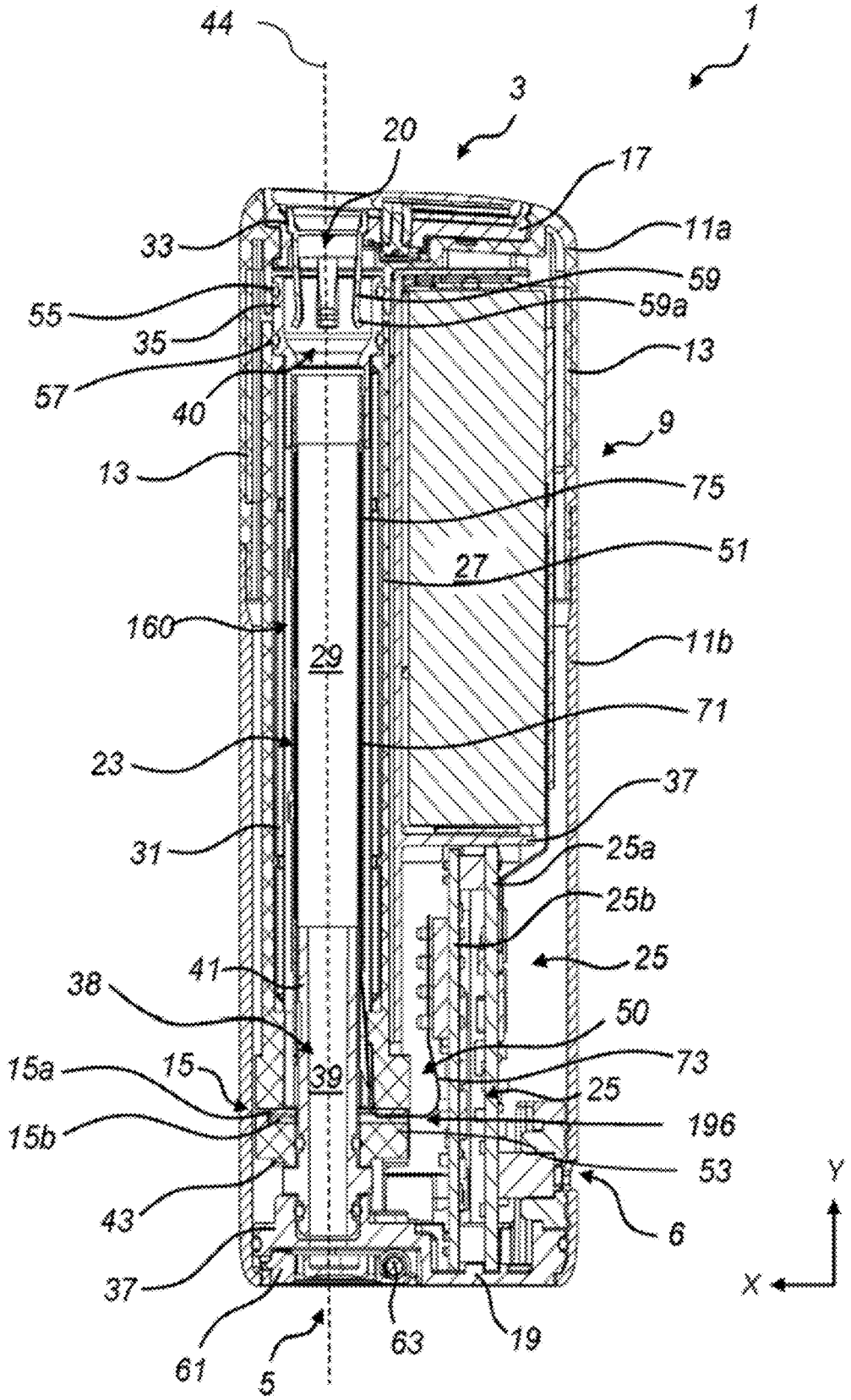
FIG. 6 shows a schematic front cross-sectional view of the example apparatus of FIG. 1 without an article inserted.

FIG. 5 and FIG. 6 show schematic front cross-sectional views of the apparatus 1 with the article inserted and withdrawn, respectively, through a line 44 of the apparatus 1, as shown in FIG. 4 and FIG. 6.

As shown in FIG. 6, the casing 9 has located or fixed therein a heater arrangement 23, control circuitry 25 and a power source 27. The heater arrangement 23 in this example is contained in a housing module 50, as will be described in more detail below. In this example, the control circuitry 25 is part of an electronics compartment and comprises two printed circuit boards (PCBs) 25*a*, 25*b*. In this example, the control circuitry 25 and the power source 27 are laterally adjacent to the heater arrangement 23 (that is, adjacent when viewed from an end), with the control circuitry 25 being located below the power source 27. Advantageously, this allows the apparatus 1 to be compact in a lateral direction, corresponding to the X-direction.

The control circuitry 25 in this example includes a controller, such as a microprocessor arrangement, configured and arranged to control the heating of the aerosolizable material in the article 21, as discussed further below.

The power source 27 in this example is a rechargeable battery. In other examples, a non-rechargeable battery, a capacitor, a battery-capacitor hybrid, or a connection to a mains electricity supply may be used. Examples of suitable batteries include for example a lithium-ion battery, a nickel battery (such as a nickel-cadmium battery), an alkaline battery and/or the like. The battery 27 is electrically coupled to the heater arrangement 23 to supply electrical power when required and under control of the control circuitry 25 to heat the aerosolizable material in the consumable (as discussed, to volatilize the aerosolizable material without causing the aerosolizable material to burn).

An advantage of locating the power source 27 laterally adjacent to the heater arrangement 23 is that a physically large power source 27 may be used without causing the apparatus 1, as a whole, to be unduly lengthy. As will be understood, in general, a physically large power source 27 has a higher capacity (that is, the total electrical energy that can be supplied, often measured in Amp-hours or the like) and thus the battery life for the apparatus 1 can be longer.

In one example, the heater arrangement 23 is generally in the form of a hollow cylindrical tube, having a hollow interior heating chamber 29 into which the article 21 comprising the aerosolizable material is inserted for heating, in use. Broadly speaking, the heating chamber 29 is a heating zone for receiving the article 21. Different arrangements for the heater arrangement 23 are possible. In some examples, the heater arrangement 23 may comprise a single heating element or may be formed of plural heating elements aligned along the longitudinal axis of the heater arrangement 23. The or each heating element may be annular or tubular, or at least part-annular or part-tubular around its circumference. In an example, the or each heating element may be a thin-film heater. In another example, the or each heating element may be made of a ceramics material. Examples of suitable ceramics materials include alumina and aluminum nitride and silicon nitride ceramics, which may be laminated and sintered. Other heater arrangements are possible, including for example inductive heating, infrared heater elements, which heat by emitting infrared radiation, or resistive heating elements formed by for example a resistive electrical winding.

In this example, the heater arrangement 23 is supported by a stainless steel support tube 75 and comprises a heater 71. In one example the heater 71 may comprise a substrate in which at least one electrically conductive element is formed. The substrate may be in the form of a sheet and may comprise for example a plastics layer. In a specific example the layer is a polyimide layer. The electrically conductive element/s may be printed or otherwise deposited in the substrate layer. The electrically conductive element/s may be encapsulated within or coated with the substrate.

The support tube 75 is a heating element that transfers heat generated by the heater 71 to the article 21. The heater arrangement 23 is dimensioned so that substantially the whole of the aerosolizable material when the article 21 is inserted in the apparatus 1 so that substantially the whole of the aerosolizable material is heated in use. In other examples, other thermally conductive materials may be used for the support tube 75. For example, the support tube 75 may comprise a metal or a metal alloy. In some examples the support tube 75 may comprise graphite or another conductive carbon material.

In some examples, the or each heating element may be arranged so that selected zones of the aerosolizable material can be independently heated, for example in turn (over time) or together (simultaneously) as desired.

The heater arrangement 23 in this example is surrounded along at least part of its length by a vacuum region 31. The vacuum region 31 helps to reduce heat passing from the heater arrangement 23 to the exterior of the apparatus 1. This helps to keep down the power requirements for the heater arrangement 23 as it reduces heat losses generally. The vacuum region 31 also helps to keep the exterior of the apparatus 1 cool during operation of the heater arrangement 23. In some examples, the vacuum region 31 may be surrounded by a double-walled sleeve wherein the region between the two walls of the sleeve has been evacuated to provide a low-pressure region so as to minimize heat transfer by conduction and/or convection. In other examples, another insulating arrangement may be used, for example using heat insulating materials, including for example a suitable foam-type material, in addition to or instead of a vacuum region.

The housing 9 may further comprise various internal support structures 37 (best seen in FIG. 6) for supporting internal components of the apparatus 1.

As mentioned above, in this example, the heater arrangement 23 and vacuum region 31 are contained within the housing module 50, which may also be referred to as a cassette. The housing module 50 defines a chamber 160 in which the heater arrangement 23 and the vacuum region 31 are located. The heating chamber 29 is accordingly also within the chamber 160. In this example, the housing module 50 comprises a first housing member 51 and a second housing member 53. The first housing member 51 is an elongate member which defines the chamber 160 and houses the heater arrangement 23. The second housing member 53 is located at a distal end of the first housing member 51 and closes the chamber 160, as will be explained in more detail below. The first and second housing members 51, 53 may in examples be formed by a suitable material, such as a plastics material, as will be discussed below in more detail.

In examples, the housing module 50 provides for containment of the heater arrangement 23. The housing module 50 may act to isolate the heater arrangement 23 and associated components for receiving the article 21 from other components of the apparatus 1, such as the control circuitry 25. This may provide, for example, that vapor or aerosol generated by the heater arrangement 23 or air heated by the heater arrangement 23 does not come into contact with other components of the device 1, such as the control circuitry 25, or at least that airflow or vapor flow between the chamber 160 and the remainder of the apparatus 1 exterior to the housing module 50 is minimized. Furthermore, the vacuum region 31 is arranged in the housing module 50 to insulate the chamber 160 and the heater arrangement 23 contained therein from parts of the apparatus 1 outside of the housing module 50.

The apparatus 1 further comprises a collar 33 which extends around and projects from the opening 20 into the interior of the housing 9 and an expansion element 35 which is located between the collar 33 and one end of the vacuum region 31. The expansion element 35 is a funnel that forms an expansion chamber 40 at the mouth end 3 of the apparatus 1. The collar 33 is a retainer for retaining the article 21 (as is best shown in FIG. 5). In this example, the retainer is reversibly removable from the apparatus 1.

One end of the expansion element 35 connects to and is supported by the first sleeve 11*a* and the other end of the expansion element 35 connects to and is supported by one end of the housing module 50, in this example by a proximal end of the first housing member 51. A first sealing element 55, shown as an o-ring, is interposed between the expansion element 35 and the first sleeve 11*a*, and a second sealing element 57, also shown as an o-ring, is interposed between the expansion element 35 and an interior surface of the first housing member 51. Each o-ring is made of silicone, however, other elastomeric materials may be used to provide the seal. The first and second sealing elements 55, 57 prevent the transmission of gas into surrounding components of the apparatus 1.

As best seen in FIG. 6, the collar 33, the expansion element 35 and the vacuum region 31/heater arrangement 23 are arranged co-axially, so that, as best seen in FIG. 5, when the article 21 is inserted in the apparatus 1, it extends through the collar 33 and the expansion element 35 into the heating chamber 29.

As mentioned above, in this example, the heater arrangement 23 is generally in the form of a hollow cylindrical tube. The heating chamber 29 formed by this tube is in fluid communication with the opening 20 at the mouth end 3 of the apparatus 1 via the expansion chamber 40.

In this example, the expansion element 35 comprises a tubular body that has a first open end adjacent the opening 20 and a second open end adjacent the heating chamber 29. The tubular body comprises a first section that extends from the first open end to approximately half away along the tubular body and a second section that extends from approximately half away along the tubular body to the second open end. The first section comprises a flared portion that widens away from the second section. The first section therefore has an internal diameter that tapers outwardly towards the opening first open end. The second section has a substantially constant internal diameter.

As best seen in FIG. 6, in this example, the expansion element 35 is located in the housing 9 between the collar 33 and the vacuum region 31/heater arrangement 23. More specifically, at the second open end, the expansion element 35 is interposed between an end portion of a support tube 75 of the heater arrangement 23 an inside of the vacuum region 31 so that the second open end of the expansion element 35 engages with the support tube 75 and the inside of the vacuum region 31. At the first open end, the expansion element 35 receives the collar 33 so that legs 59 of the collar 33 project into the expansion chamber 40. Therefore, an inner diameter of the first section of the expansion element 35 is greater than an external diameter of the legs when the article 21 is received in the apparatus 1 (see FIG. 5) and when no article 21 is present.

As is best appreciated from FIG. 5, the inner diameter of the first section of the expansion element 35 is larger than the external diameter of the article 21. There is therefore an air gap 36 between the expansion element 35 and the article 21 when the article 21 is inserted in the apparatus 1 over at least part of the length of the expansion element 35. The air gap 36 is around the entire circumference of the article 21 in that region.

As best seen in FIG. 6, the collar 33 comprises a plurality of legs 59. In this example there are four legs 59, where only three are visible in the view of FIG. 6. However, in other examples there may be more or fewer than four legs 59. The legs 59 are arranged circumferentially equally spaced around an inner surface of the collar 33 and exist in the expansion chamber 40 when the apparatus 1 is assembled. In this example, when installed in the apparatus 1, the legs 59 are circumferentially equally spaced around the periphery of the opening 20. Each of the legs 59 extend in the Y-direction and parallel to a longitudinal axis 44 (represented with a dotted line in FIG. 6) of the expansion chamber 40 and project into the opening 20. The legs 59 also extend radially at a tip 59*a* of the leg 59 in a direction towards the expansion element 35 such that the tips 59*a* are angled away from each other. The tip 59*a* of each leg 59 provides for improved passage of the article 21 so as to avoid damage to the article 21 when inserting and/or removing the article 21 from the apparatus 1. Together, the legs 59 provide a gripping section that grips the article 21 in order to correctly position and retain the portion of the article 21 that is within the expansion chamber 40 when the article 21 is within the apparatus 1. Between them, the legs 59 gently compress or pinch the article 21 in the region or regions of the article 21 that are contacted by the legs 59.

The legs 59 may be comprised of a resilient material (or be resilient is some other way) so that they deform slightly (for example compress) to better grip the article 21 when the article 21 is inserted in the apparatus 1 but then regain their original shape when the article 21 is removed from the apparatus 1 since the legs 59 are biased to a rest position shown in FIG. 6. Therefore, the legs 59 are reversibly movable from a first position, which is the rest position, to a second position, which is a deformed position shown in FIG. 5, whereby the article 21 is gripped. In this embodiment, the legs 59 are formed integrally with a main body of the collar 33. However, in some embodiments, the legs 59 may be separate components that are attached to the body of the collar 33. The inner diameter of the space formed between the legs 59 in the first, rest position, may be, for example, between 4.8 mm and 5 mm, and preferably 4.9 mm. The legs 59 take up space within the opening 20 such that the open span of the opening 20 at the locations of the legs 59 is less than the open span of the opening 20 at the locations without the legs 59.

The expansion element 35 may be formed of for example a plastics material, including for example polyether ether ketone (PEEK). PEEK has a relatively high melting point compared to most other thermoplastics, and is highly resistant to thermal degradation.

Referring to FIG. 6, in this example, the heating chamber 29 communicates with a region 38 of reduced internal diameter towards the distal end 5. This region 38 defines a clean-out chamber 39 formed by a clean-out tube 41. The clean-out tube 41 is a hollow tube that provides an end stop for the article 21 passed through the opening at the mouth end 3 (see FIG. 5). In some examples, the clean-out tube 41 is arranged to support and locate the heater arrangement 23 in the chamber 160.

The apparatus 1 may further comprise a door 61 at the distal end 5 of the apparatus 1 that opens and closes an opening in the bottom panel 19 to provide access to the heating chamber 29 so that the heating chamber 29 can be cleaned. The door 61 pivots about a hinge 63. This access through the door 61 particularly enables the user to clean within the heater arrangement 23 and the heating chamber 29 at the distal end 5. When the door 61 is open, a straight through-bore is provided through the whole apparatus 1 between the opening 20 at the mouth end 3 and an opening at one end of the clean-out chamber at the distal end 5 of the apparatus 1. The user is therefore easily able to clean through substantially the whole of the interior of the hollow heating chamber 29. For this, the user can access the heating chamber 29 via either end of the apparatus 1 at choice. The user may use one or more various cleaning devices for this purpose, including for example a classic pipe cleaner or a brush or the like.

As shown in FIG. 6, the top panel 17 generally forms the first end 3 of the housing 9 of the apparatus 1. The top panel 17 supports the collar 33 which defines an insertion point in the form of the opening 20 through which the article 21 is removably inserted into the apparatus 1 in use.

The collar 33 extends around and projects from the opening 20 into the interior of the housing 9. In this example, the collar 33 is a distinct element from the top panel 17, and is attached to the top panel 17 through an attachment, such as a bayonet locking mechanism. In other examples, an adhesive or screws may be used to couple the collar 33 to the top panel 17. In other examples, the collar 33 may be integral with the top panel 17 of the housing 9 so the collar 33 and the top panel 17 form a single piece.

As best appreciated from FIG. 5, open spaces defined by adjacent pairs of legs 59 of the collar 33 and the article 21 form ventilation paths around the exterior of the article 21. These ventilation paths, allow hot vapors that have escaped from the article 21 to exit the apparatus 1 and allow cooling air to flow into the apparatus 1 around the consumable 21. In this example, four ventilation paths are located around the periphery of the article 21, which provide ventilation for the apparatus 1. In other examples, more or fewer such ventilation paths may be provided.

Referring again particularly to FIG. 5, in this example, the article 21 is in the form of a cylindrical rod which has or contains aerosolizable material 21*a* at a rear end in a section of the article 21 that is within the heater arrangement 23 when the article 21 is inserted in the apparatus 1. A front end of the article 21 extends from the apparatus 1 and acts as a mouthpiece assembly 21*b* which includes one or more of a filter for filtering aerosol and/or a cooling element 21*c* for cooling aerosol. The filter/cooling element 21*c* is spaced from the aerosolizable material 21*a* by a space 21*d* and is also spaced from a tip of mouthpiece assembly 21*b* by a further space 21*e*. The article 21 is circumferentially wrapped in an outer layer (not shown). In this example, the outer layer of the article 21 is permeable to allow some heated volatilized components from the aerosolizable material 21*a* to escape the article 21.

In operation, the heater arrangement 23 will heat the article 21 to volatilize at least one component of the aerosolizable material 21*a*.

The primary flow path for the heated volatilized components from the aerosolizable material 21*a* is axially through the article 21, through the space 21*d*, the filter/cooling element 21*c* and the further space 21*e* before entering a user's mouth through the open end of the mouthpiece assembly 21*b*. However, some of the volatilized components may escape from the article 21 through its permeable outer wrapper and into the space 36 surrounding the article 21 in the expansion chamber 40.

It would be undesirable for the volatilized components that flow from the article 21 into the expansion chamber 40 to be inhaled by the user, because these components would not pass through the filter/cooling element 21*c* and thus be unfiltered and not cooled.

Advantageously, the volume of air surrounding the article 21 in the expansion chamber 40 causes at least some of the volatilized components that escape the article 21 through its outer layer to cool and condense on the interior wall of the expansion chamber 40 preventing those volatilized components from being possibly inhaled by a user.

This cooling effect may be assisted by cool air that is able to enter from outside the apparatus 1 into the space 36 surrounding the article 21 in the expansion chamber 40 via the ventilation paths, which allows fluid to flow into and out of the apparatus. A first ventilation path is defined between a pair of the plurality of neighboring legs 59 of the collar 33 to provide ventilation around the outside of the article 21 at the insertion point. A second ventilation path is provided between a second pair of neighboring legs 59 for at least one heated volatilized component to flow from the article 21 at a second location. Therefore, ventilation is provided around the outside of the article 21 at the insertion point by the first and second ventilation paths. Furthermore, heated volatilized components that escape the article 21 through its outer wrapper do not condense on the internal wall of the expansion chamber 40 and are able to flow safely out of the apparatus 1 via the ventilation paths 61 without being inhaled by a user. The expansion chamber 40 and the ventilation both aid in reducing the temperature and the content of water vapor composition released in heated volatilized components from the aerosolizable material.

The apparatus 1 is fitted with a thermal liner 13 towards the first end 3 of the apparatus 1. As shown in FIG. 6, the liner 13 is coupled with the first sleeve 11*a*. The thermal liner 13 helps to protect the first sleeve 11*a* from thermal stress by distributing internal heat generated by use of the apparatus 1 over a larger area. The thermal liner 13 is made from a metallic material such as aluminum in order to be lightweight and sufficiently spread heat around the proximal end 3. This helps to avoid localized hot spots and increases the longevity of the first sleeve 11*a*. The liner 13 distributes heat by conduction. The liner 13 is not configured to insulate heat or reflect heat by radiation.

As shown in FIG. 6, the support tube 75 is externally wrapped by a heater 71. In an example, the heater 71 is a thin-film heater comprising polyimide and electrically conductive elements, for example as has been described above. The heater 71 may comprise a plurality of heating regions that are independently controlled and/or simultaneously controlled. In this example, the heater 71 is formed as a single heater.

However, in other examples, the heater 71 may be formed of a plurality of heaters aligned along the longitudinal axis of the heating chamber 29. In some examples, a plurality of temperature sensors (not shown) may be used to detect the temperature of the heater 71 and/or support tube 75. The support tube 75 in this example is made from stainless steel to conduct heat from the heater 71 towards the article 21 when the article 21 is inserted in a heating zone (the heating zone is defined by the thermal conduction region of the support tube 75). In other examples, the support tube 75 may be made from a different thermally conductive material. Other heating elements 75 may be used in other examples. For example the heating element may be a susceptor that is heatable by induction. In this example, the support tube 75 acts as an elongate support for supporting, in use, the article 21 comprising aerosolizable material.

In this example, the heater 71 is located externally of the support tube 75. However, in other examples, the heater 71 may be located internally of the support tube 75. The heater 71 in this example comprises a portion that passes outside of the support tube 75 and is referred to herein as a heater tail 73. The heater tail 73 extends out of the chamber 160 defined by the housing module 50 and containing the heater arrangement 23. The heater tail 73 is an electrical connecting member configured to provide electrical connection of the heater arrangement 23 to the control circuitry 25. In the example shown, the heater tail 73 physically connects the heater 71 to one PCB 25*a*. An electrical current may be provided by the power source 27 to the heater 71 via the control circuitry 25 and the heater tail 73. In examples, the heater tail 73 also connects to one or more temperature sensors (not shown) located in the chamber 160 containing the heater arrangement 23. In an example, the one or more temperature sensors comprises one or more resistance temperature detectors (RTD). In another example, the one or more temperature sensors may comprise one or more thermocouples. The one or more temperature sensors may be arranged to detect a temperature of the heater arrangement 23. The heater tail 73 in examples is configured to electrically connect the one or more temperature sensors via, for example via electrically conductive elements, to the control circuitry 25.

A passageway 196 is provided which allows the heater tail 73 to exit the chamber 160 defined by the housing module 50 to connect to the control circuitry 25.

The heater tail 73 in this example comprises a polyimide sheet, similar to that forming the heater 71. The heater tail 73 has a width (in the Z direction as shown in the figures when arranged in the housing module 50) significantly greater than its thickness (in the Y direction at the passageway 196). In the manner described above for the heater 71, the heater tail 73 comprises electrically conductive elements formed in a polyimide substrate.

Figure 7:
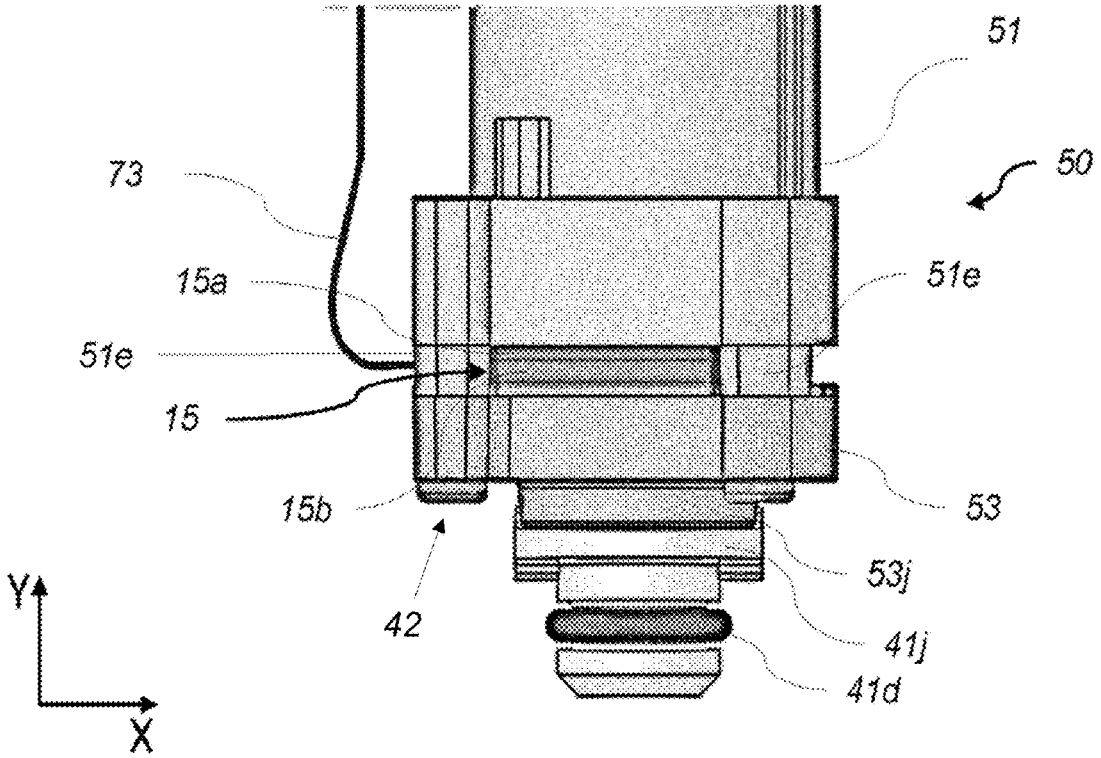
FIG. 7 shows a schematic rear view of a portion of an example housing module for the example apparatus of FIG. 1.
Figure 8:
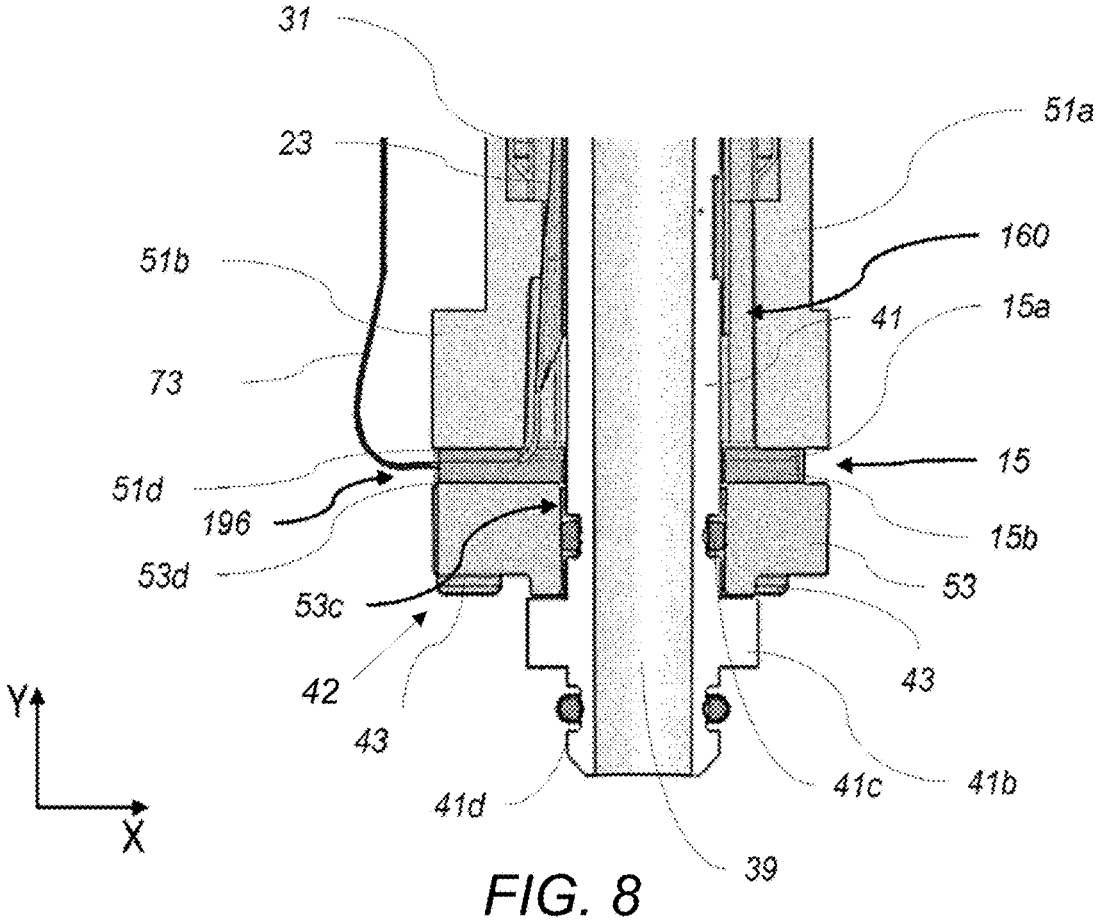
FIG. 8 shows a schematic rear cross-sectional view of the portion of the example housing module shown in FIG. 7.

FIG. 7 is a side view of a distal portion of the housing module 50 and components associated therewith. FIG. 8 shows the same portion of the housing module 50 as shown in FIG. 7 but in a cross-sectional view.

The arrangement for allowing the heater tail 73 to exit the housing module 50 in the example apparatus 1 can be understood with reference to FIGS. 7 and 8. FIG. 8 shows the passageway 196 provided between a distal end 51*d* of the first housing member 51 and a proximal end 53*d* of the second housing member 53. A sealing arrangement 15 is provided to seal the passageway 196 to substantially prevent airflow (or the flow of any other fluids) between the chamber 160, for example between the heating chamber 29, and the remainder of the interior of the apparatus 1. The sealing arrangement 15 comprises a first sealing member 15*a* and a second sealing member 15*b*. The sealing members 15*a*, 15*b* may be resilient members. The sealing members 15*a*, 15*b* may be elastomeric members. The sealing members 15*a*, 15*b* may be made of, for example, one or more polymers such as silicone or rubber, which may be injection molded, for example. In another example, one or more of the sealing members 15*a*, 15*b* may comprise overmolded polyurethane.

The first and second sealing members 15*a*, 15*b*, in this example, are silicone gaskets. The heater tail 73 exits between the silicon gaskets 15*a*, 15*b* and the sealing arrangement 15 is caused to seal the passageway 196 by compressing the silicon gaskets 15*a*, 15*b* together between a distal end 51*d* of the first housing member 51 and a proximal end 53*d* of the second housing member 53.

The second housing member 53 is attached to the first housing member 51 via an attachment arrangement 42, examples of which will be described below. When the second housing member 53 is suitably attached to the first housing member 51 the first and second sealing members 15*a*, 15*b* are held in abutment with one another by the first housing member 51 and the second housing member 53, with the heater tail 73 between the first and second sealing members 15*a*, 15*b*, to seal the passageway 196. The attachment arrangement 42 holds the first and second housing members 51, 53 together to provide a compressive force on the sealing arrangement 15 to seal the passageway 196. The heater tail 73 in this example is held substantially flat between the sealing members 15*a*, 15*b* by the compressive force exerted by the first and second housing members 51, 53. This is advantageous in providing a good seal of the passageway 196. Furthermore, the sealing members 15*a*, 15*b* are shaped to abut the heater tail 73 to provide a good seal. That is, the heater tail 73 is a substantially flat sheet, as has been described elsewhere herein. A proximal surface of the heater tail 73 is contacted by a distal surface of the first sealing member 15*a* and a distal surface of the heater tail 73 is contacted by a proximal surface of the second sealing member 15*b*. Accordingly, by providing a compression force on the sealing elements 15*a*, 15*b* with the heater tail 73 arranged therebetween, a good surface is made by contact between the surfaces of the heater tail 73 and the sealing members 15*a*, 15*b*. For example, since the sealing members 15*a*, 15*b* are resilient, they may slightly deform around the heater tail 73. In other examples, the heater tail 73 may be a differently shaped electrical connecting member, for example cylindrical in profile with having a longitudinal axis extending through the passageway. In some examples, the sealing members may be differently shaped in order to conform to a differently profiled heater tail and to make a good seal therewith.

The first housing member 51 comprises a tubular portion 51*a* towards its proximal end and a flange 51*b* toward its distal end 51*d*. The flange 51*b* facilitates connection of the second housing member 53 to the first housing member 51. In this example, the attachment arrangement 42 comprises a plurality of screws 43. The plurality of screws 43 are arranged to provide, in this example, a releasable attachment arrangement between the first housing member 51 and the second housing member 53. In this example the attachment arrangement 42 comprises four screws 43, extending through four respective holes parallel to the longitudinal axis 44 through the second housing member 53, to be received by a plurality of corresponding threaded holes located in the longitudinally extending corner portions 51*e* of the flange 51*b*. To attach the second housing member 53 to the first housing member 51, the screws 43 are inserted through the holes in the second housing member 53 to be received in threaded connection in the threaded holes in the corner portions 51*e* of the first housing member 51.

In this example, the screws 43, when sufficiently tightened, secure the second housing member 53 to the first housing member 51 and cause the sealing arrangement 15 to seal the passageway 196. The screws 43 may be tightened to a pre-determined torque to cause the sealing arrangement 15 to suitably seal the passageway 196.

In examples, the seal provided by this sealing arrangement 15 is a substantially hermetic seal. The sealing arrangement 15 may minimize or prevent air or vapor passing through the passageway 196 into or out of the chamber 160. The hermetic seal of the passageway 196 may be such that at most only a negligible amount of air flows through the passageway 196 into or out of the chamber 160.

In other examples, the attachment 42 between the first housing member 51 and the second housing member 53 may comprise a different number of fastening members, e.g. a different number of screws 43, or may comprise one or more of another type of connection. For example, the attachment 42 may comprise a different type of threaded connection, such as one or more bolts to be secured respectively with one or more corresponding nuts. In examples, the attachment 42 may be any suitable attachment 42 which provides for the first housing member 51 to be attached to the second housing member 53 to secure the sealing arrangement 15 between the first and second housing members 51, 53. As mentioned above, in examples such as that shown in the figures, the attachment 42 may be releasable. In some examples, the attachment 42 may provide for movement between the second housing member 53 and the first housing member 51, when the attachment 42 is in a particular configuration. For example, the attachment 42 may allow the second housing member 53 to move in the longitudinal direction away from the first housing member 51, while the second housing member 53 remains attached to the first housing member 51 by the attachment 42.

The attachment 42 in examples also allows movement of the second housing member 53 relative to the first housing member 51 when the screws 43 are not tightened, for example, when the screws 43 are loosened or when the screws 43 are removed from their corresponding holes. The arrangement allows the housing module 50 to be assembled with the heater tail 73 exiting therefrom and the attachment 42 configured to seal the passageway 196. This may provide for convenient assembly for the apparatus 1 wherein the assembled housing module 50 may be fitted therein.

Also shown in FIG. 7 and FIG. 8 is the end tube 41. The end tube 41 extends into the housing module 50 as described above with reference to earlier figures. The second housing member 53 comprises a lip 53*j* against which a ridge 41*j* of the end tube 41 is configured to abut. The ridge 41*j* may comprise a protruding feature 41*k* (shown in FIG. 9) for interacting with a corresponding feature 53*k* on the lip 53*j*. This may provide for alignment between the end tube 41 and the second housing member 53. The end tube 41 is inserted along a longitudinal axis 44 of the housing module 50 through an aperture 53*c* through the second housing member 53. A first end tube o-ring 41*c* provides a seal between the end tube 41 and walls of the aperture 53*c*. A second end tube o-ring 41*d* provides a seal between the end tube 41 and the internal support structure 37 when the apparatus 1 is assembled to contain the housing module 50 and associated components.

Figure 9:
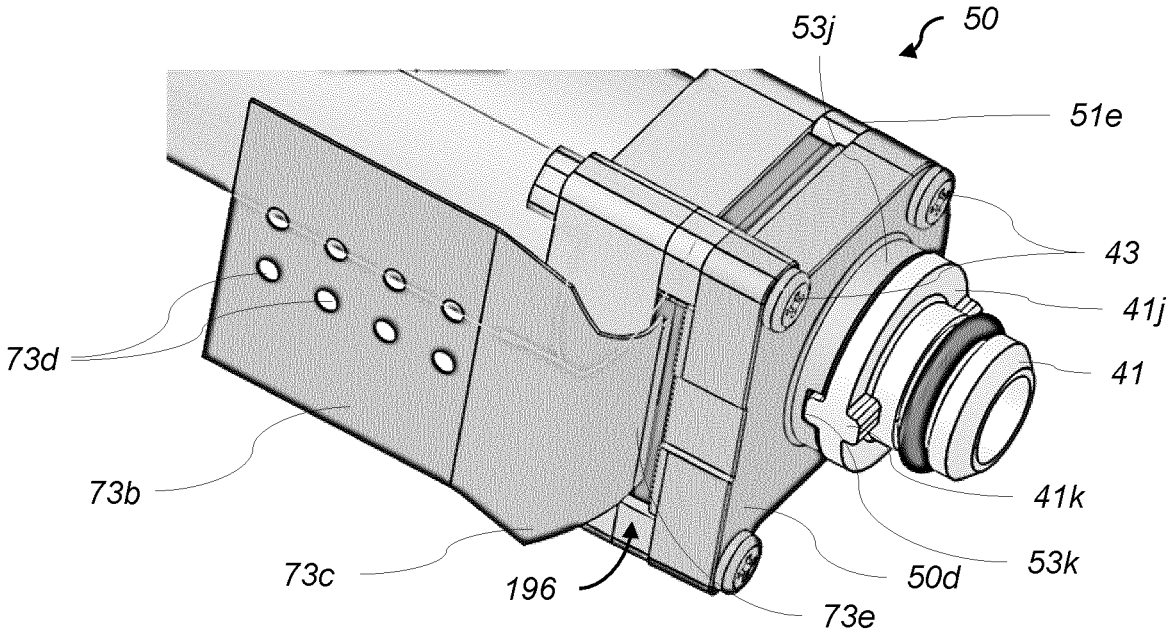
FIG. 9 shows a schematic perspective rear view of the portion of the example housing module shown in FIG. 7.
Figure 10:
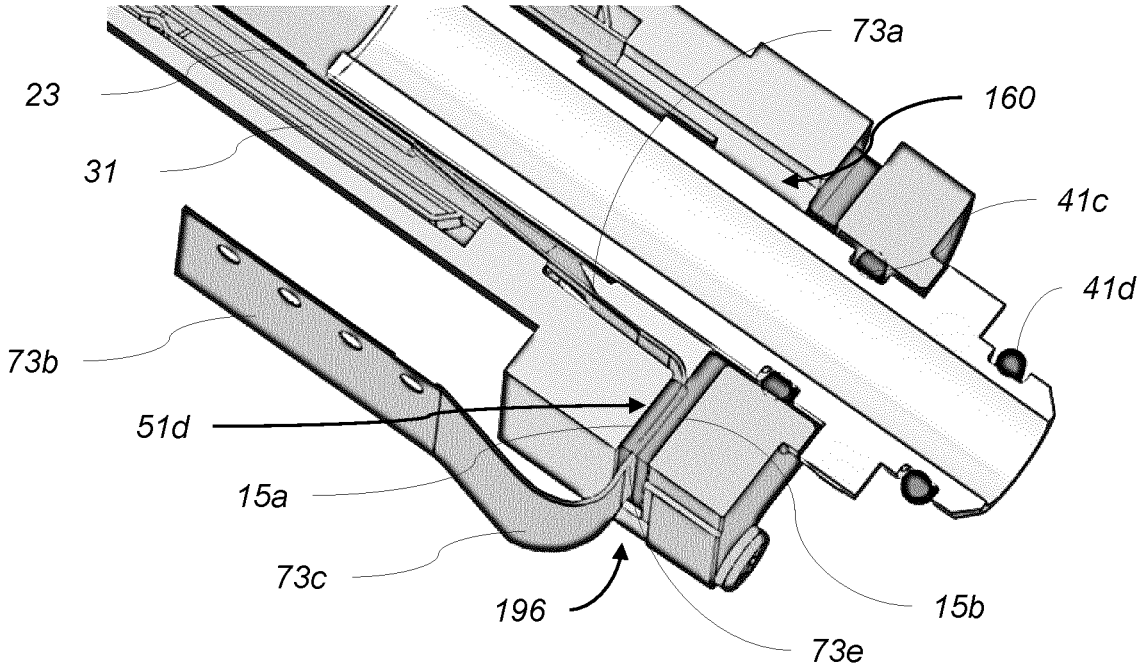
FIG. 10 shows a schematic cross-sectional perspective rear view of the portion of the example housing module shown in FIG. 7.

FIG. 9 shows a perspective view of the portion of the housing module 50 and associated components shown in FIGS. 7 and 8. FIG. 10 shows the same portion of the housing module 50 as shown by FIG. 9 but in a cross-sectional perspective view. The heater tail 73, as can be appreciated from FIG. 9 and FIG. 10, comprises a first portion 73*a* for connecting to the heater 71 and a second portion 73*b* for connecting to the PCB 25*b*, as is shown in FIG. 6. In this example, the second portion 73*b* has a width (in the Z direction shown in the Figures) greater than that of the first portion 73*a*. The second portion 73*b* of the heater tail 73 comprises a plurality of connection features 73*d*, in this example apertures, for allowing the heater tail 73 to make an electrical connection to the PCB 25*b*, as is also shown in FIG. 6.

A third portion 73*e* of the heater tail 73 extends through the passageway 196 and is held between the first sealing member 15*a* and the second sealing member 15*b*. In this example, the passageway 196 extends perpendicularly to a longitudinal axis 44 of the housing module 50, and the third portion 73*e* extends in a direction defined by the passageway 196.

The second portion 73*b* of the heater tail 73 extends substantially parallel to the longitudinal axis 44. In this example the direction in which the second portion 73*b* extends is determined by the layout of the PCB 25*b* with respect to the housing module 50. That is, the PCB 25*b* is arranged substantially parallel with and adjacent to the housing module 50. This may provide a layout for the components within the apparatus 1 which makes efficient use of available space, as has been described above. To provide the change in direction in the heater tail 73 after exiting the passageway 196, a bent portion 73*c* in the heater tail 73 is provided. The bent portion 73*c* in this example provides for the substantially 90° upward change of direction in the heater tail 73. The bent portion 73*c* also widens towards the second portion 73*b* of the heater tail 73. In this example, the bent portion 73*c* provides a single bend in the heater tail 73 after exiting the passageway 196. The upward change in direction of the heater tail 73 allows the second portion 73*b* for connecting to the PCB 25*b* which is laterally adjacent to the housing module 50.

The passageway 196 is located away from a longitudinal end 50*d* of the housing module 50. The passageway 196 is also located away from a proximal end of the housing module 50, i.e. a proximal end of the first housing member 51. In this example, as mentioned above, the location of the passageway 196 allows for the heater tail 73 to exit the chamber 160 in a direction perpendicular to the longitudinal axis 44 of the housing module 50. This may provide an advantage in that fewer bends are required to be made in the heater tail 73 outside of the housing module 50. For example, if the heater tail 73 exited the housing module 50 at the distal end 50*d*, two 90° bends or the equivalent thereof may be required to provide for the second portion 73*c* of the heater tail 73 to extend parallel and adjacent to the PCB 25*b* in the arrangement of the example apparatus 1. Minimizing the number of bends or the angle through which the heater tail 73 is bent after exiting the passageway 196 may reduce the likelihood of damage being done to the heater tail 73, for example when fitting the housing module 50 into the apparatus 1. For example, a bend in the heater tail 73 may provide a relative weak point which is more susceptible to damage through mechanical stress than neighboring unbent portions.

It will be noted that the first portion 73*a* of the heater tail 73 comprises an upward bend inside the chamber 160 defined by housing module 50. This bend is secured within the housing module 50 and the first portion 73*a* of the heater tail 73 is held in place between the silicon gaskets 15*a*, 15*b* when the screws 43 are suitably tightened. The bend in the third portion 73*e* is accordingly contained within the chamber 160 and is supported by the sealing arrangement 15 and protected from damage by mechanical stress.

Furthermore, the arrangement in which the heater tail 73 is configured to exit the housing module 50 from a side, rather than a proximal or distal end, allows the heater tail 73 to exit at a point which is closer to the PCB 25*b*. This can allow the heater arrangement 23 to be located closer to the PCB 25*b* and can contribute to more efficient performance of the heater arrangement 23.

In this example, the passageway 196 extends perpendicularly to the longitudinal axis 44. However, it will be appreciated that in other examples the passageway 196 may be located away from the proximal and distal ends of the housing module 50 but may extend in a different direction other than perpendicularly to the longitudinal axis 44. For example, the passageway 196 may extend laterally but nor perpendicularly to the longitudinal axis 44, for example at an angle not equal to 90° to the longitudinal axis 44. In examples, the passageway 196 may be located at any point along the housing module 50, but away from a distal and proximal end thereof.

Figure 11:
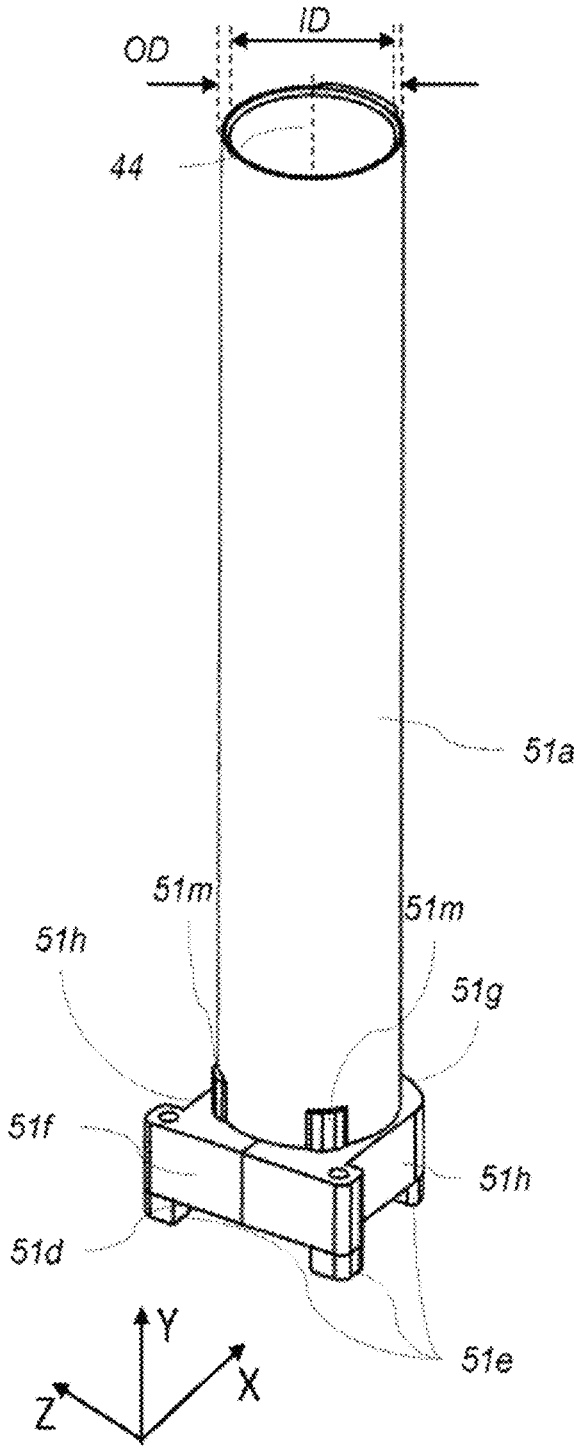
FIG. 11 shows a schematic perspective view of first housing member of the example housing module.

FIG. 11 shows a perspective view of the first housing member 51 in isolation.

Figure 12:
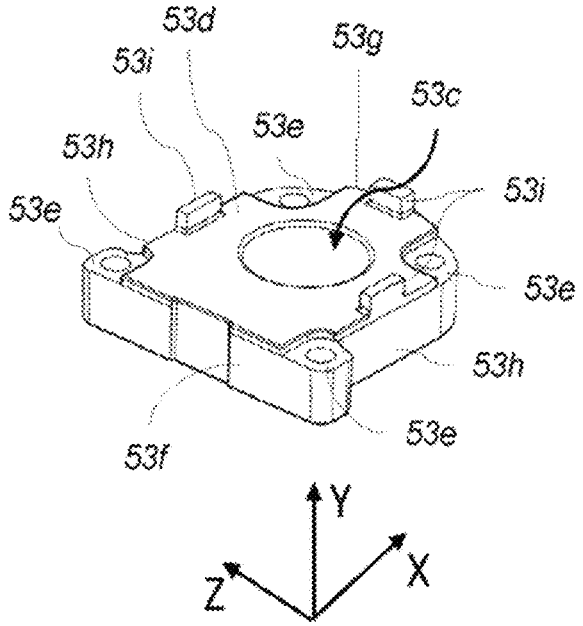
FIG. 12 shows a schematic perspective view of the second housing member of the example housing module.

FIG. 12 shows the second housing member 53 in isolation, viewed from a proximal end 53*d*.

As can be seen from FIG. 11 and FIG. 12, the flange 51*b* and the second housing member 53 have corresponding cross-sections parallel to the X and Z plane. First sides 51*f*, 53*f* of the flange 51*b* and the second housing member 53 are substantially straight, and it is between these first sides 51*f*, 53*f* that the passageway 196 is provided when the first and second housing members 51, 53 are attached to one another. Second sides 51*g*, 53*g* are substantially semi-circular and are shaped to allow the housing module 50 to be accommodated adjacent to an interior curved wall of the casing 9 of the apparatus 1. Between the first sides 51*f*, 53*f* and second sides 51*g*, 53*g* are straight sides 51*h*, 53*h*.

Shown in FIG. 12, the proximal end 53*d* of the second housing member 53 defines a substantially flat surface against which the second sealing member 15*b* is placed. The second housing member 53 has, on the surface at its proximal end 53*d*, indented corner portions 53*e* offset below the proximal end 53*d* of the second housing member 53. The indented portions 53*e* are for contacting the screw receiving portions 51*e* of the first housing member 51. Protruding portions 53*i*, in this example three protruding portions 53*i*, extend in a proximal direction and allow for alignment of the sealing members 15*a*, 15*b* between the first and second housing members 51, 53.

With reference to FIG. 11, the first housing member 51 in this example has a longitudinal axis 44 and a height, in a Y-direction parallel to the longitudinal axis 44, of around 69.85 mm. This includes a length of the corner portions 51*e* of the flange 51*b* which extend around 1.6 mm in the Y-direction. The flange 51*b*, including the corner portions 51*e*, has a height in the Y-direction of around 4.65 mm; a depth in an X-direction between the first side 51*f* and the second side 51*g* of around 14.6 mm; and a width in the Z-direction between the two opposing straight sides 51*h* of around 15.6 mm. The first housing member 51 in this example is made from PEEK material, for example by injection molding. In other examples, the first housing member 51 may be formed of polycarbonate, or polyethersulfone (PES), or another suitable polymer. In examples, the first housing member 51 may be formed of a heat resistant material, due to close proximity of the material of the first housing member 51 to the heater arrangement 23. The first housing member 51 may be formed of a material capable of resisting temperatures of at least around 100° C. In other examples, the first housing member 51 could be formed from a metal or ceramic material, for example by casting.

The tubular portion 51*a* of the first housing member 51 has an outer diameter OD of around 11.6 mm and an inner diameter ID of around 10.6 mm. The tubular portion 51*a* has walls of thickness of around 0.5 mm. The tubular portion 51*a* in this example comprises wall portions 51*m* slightly thicker than the remainder of the tube 51*a*, towards the distal end of the tube 51*a* and adjacent to the flange 51*b*. These thickened portions 51*m* provide for the cross-section of the chamber 160 to expand as described herein, towards the distal end of the tube 51*a*.

With reference to FIG. 12, in this example, the second housing member 53 has a height in the Y-direction of around 4.55 mm. The second housing member 53 has a depth in the X-direction of around 14.6 mm and a width in the Z-direction of around 15.6 mm. The flange 51*b* has a depth and width in the X and Z directions respectively which is equal to that of the flange 51*b*. The second housing member 53 is configured to act as an end cap on the first housing member 51 having substantially the same cross-section as the flange 51*b*. The second housing member 53 is formed of polycarbonate in this example and may be formed, for example, by injection molding. In other examples, the second housing member 53 may be formed from a different polymer for example acrylonitrile butadiene styrene (ABS) or PEEK. In other examples, the second housing member 53 may be made of a metal or ceramics material, for example by casting. The second housing member 53 in examples is typically not in such close proximity with the heater arrangement 23 as is the first housing member 51. As such, the second housing member 53 may in some examples be formed of a material which is not as resistant to heat as the material used to form the first housing member 51.

Figure 13:
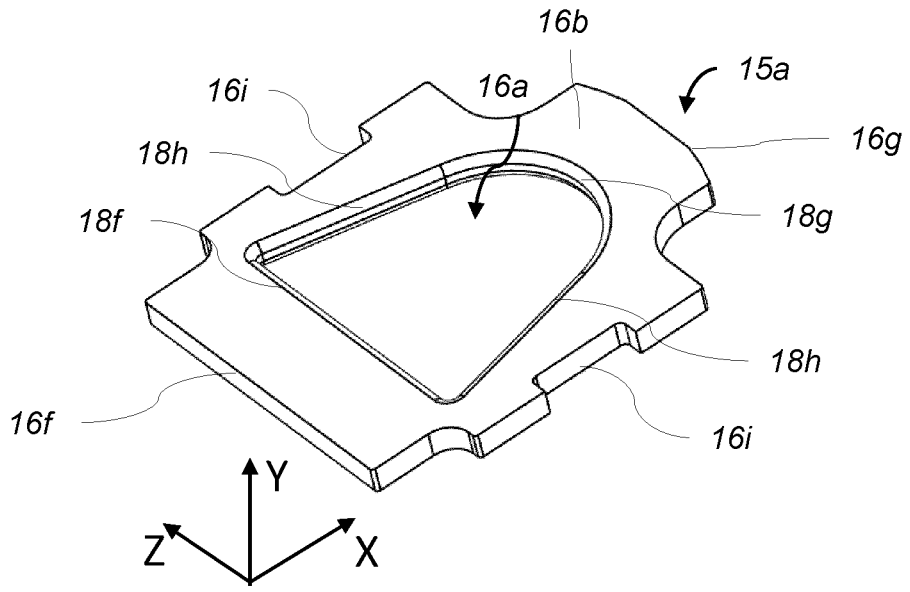
FIG. 13 shows a top down perspective view first example sealing member.

FIG. 13 shows a perspective view of a proximal surface 16*b* of the first sealing member 15*a*. In this example the first sealing member 15*a* is a silicone gasket as described above. The proximal surface 16*b* of the first sealing member 15*a* is configured to abut the distal end 51*d* of the first housing member 51 as has been previously described. The first sealing member 15*a* has cutaway portions 16*i* to interact with the protruding portions 53*i* of the second housing member 53 to provide correct alignment of the first sealing member 15*a*. A first side 16*f* of the first sealing member 15*a* is configured for being arranged parallel with both first sides 51*f*, 53*f* of the first and second housing members 51, 53. A second side 16*g* of the first sealing member 15*a* is slightly curved and is configured for being aligned adjacent the second sides 51*g*, 53*g* of the first and second housing members 51, 53. The second side 16*g* is configured to fit up against the protruding portion 53*i* toward the second side 53*g* of the second housing member 53.

The first sealing member 15*a* has a first aperture 16*a*. The central aperture 16*a* allows the end pipe 41 to extend through in the Y-direction into the chamber 160 which, when the apparatus 1 is assembled, is located proximal of the first sealing member 15*a*. The first aperture 16*a* has a first edge 18*f* which is parallel to the first side 16*f* and is of similar width thereto. The first aperture 16*a* further has a second edge 18*g* which has the profile of an arc. The first aperture 16*a* comprises two straight edges 18*h* which converge from the wider straight first edge 18*f* to the narrower arc profiled second edge 18*g*.

The first aperture 16*a* is shaped to correspond to the profile of a distal end of the chamber 160. As can be seen in FIG. 8 and FIG. 10, in this example the chamber 160 widens toward the distal end 51*d* of the first housing member 51. This allows the first portion 73*a* of the heater tail 73 to extend adjacent to the end tube 41 down to the passageway 196. The widened shape of the first aperture 16*a* toward the first side 18*f* allows the heater tail 73 to extend through the first aperture 16*a* and therefore to extend through the passageway 196 between the first and second sealing members 15*a*, 15*b*.

The first sealing member 15*a* has dimensions in the X and Z dimensions respectively substantially equal to the corresponding dimensions of the flange 51*b* and the second housing member 53 between which the first sealing member 15*a* is configured to fit. Both the first sealing member 15*a* and the second sealing member 15*b* have a thickness in the Y direction of around 0.75 mm.

Figure 14:
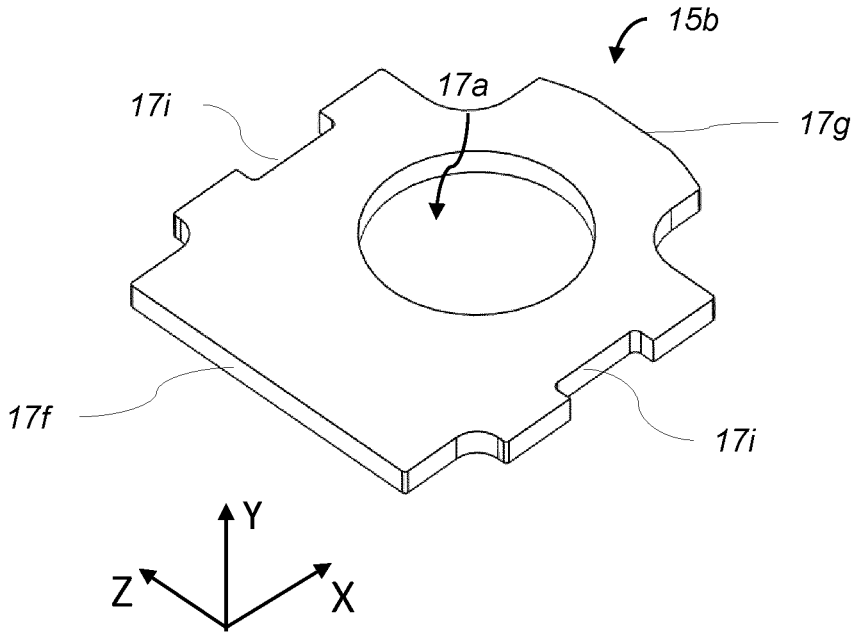
FIG. 14 shows a top down perspective view of a second example sealing member.

FIG. 14 shows the second sealing member 15*b*. The second sealing member 15*b* is configured to be placed abutting the proximal end 53*d* of the second housing member 53. As described previously, the first and second sealing members 15*a*, 15*b* are configured to be compressed together, with the third portion 73*e* of the heater tail 73 passing between them, to seal the passageway 196. The second sealing member 15*b* also comprises cutaway portions 17*i*, similar to the cutaway portions 16*i* of the first sealing member 15*a*, to provide alignment with the first and second housing members 51, 53. Similarly, the second sealing member 15*b* comprises a straight first side 17*f* and a curved second side 17*g*. The first and second sides 17*f*, 17*g* of the second sealing member 15*b* are configured to be arranged in use parallel respectively with the first and second sides 16*f*, 16*g* of the first sealing member 15*a*. The second sealing member 15*b* has a second aperture 17*a* of circular profile which is configured to receive the end tube 41 and which may be configured to contact a periphery of the end tube 41 to provide a seal around the end tube 41. The second aperture 17*a* has a diameter of around 6.05 mm.

As described with reference to the Figures, in some examples, the heater tail 73 comprises a sheet. The third portion 73*e* when arranged to exit the passageway 196 in such examples, may be arranged as a sheet which is parallel with and located between planes defined substantially perpendicular to the Y axis by the sealing members 15*a*, 15*b*. This arrangement may be advantageous in providing a good seal between the first and second sealing members 15*a*, 15*b*, with the heater tail portion 73*e* arranged parallel between the two, and the elastomeric sealing members 15*a*, 15*b* being compressed around the heater tail portion 73*e*. However, in other examples, a differently shaped electrical connecting member may be arranged to extend through a sealed passageway into the chamber 160 to connect to a heater arrangement therein. For example, one or more electrical connecting members, such as one or more tubular connecting members, such as electrically conducting wires, may be used.

While in examples described with reference to the figures the sealing arrangement 15 comprises two sealing members 15*a*, 15*b*, in other examples, the sealing arrangement 15 may comprise a different number of sealing members, for example only one sealing member. In such examples, the sealing member may be an elastomeric sealing member, such as one comprising silicone. For example, where the sealing arrangement 15 only comprises one sealing member, the sealing member may be compressed between the distal end 51*d* of the first housing member 51 and the proximal end 53*d* of the second housing member 53 to seal the passageway 196. The heater tail 73 in an example with only one sealing member may for example be located between the sealing member and one of the distal end 51*d* of the first housing member 51 and the proximal end 53*d* of the second housing member 53.

Although the example apparatus 1 described with reference to the figures comprises a resistive heating arrangement in other examples the apparatus may comprise an induction heating arrangement. For example, a susceptor arrangement may be provided that is heatable by penetration with varying magnetic fields to generate eddy currents and/or heat by magnetic hysteresis to heat an interior volume of the susceptor. In use the respective varying magnetic fields may be generated by at least one coil having a varying current flowing therethrough to penetrate the susceptor. In some examples, respective portions of the susceptor may be heatable by penetration with respective varying magnetic fields. In some examples, control circuitry of the device may be configured to cause heating of respective portions of the susceptor, for example, at different respective times, for different respective durations, and/or at different respective rates.

Where the apparatus comprises an inductive heating arrangement a component arranged in the manner of the support tube 75 may be a susceptor comprising a heating material. In some examples, the heating material may be aluminum. However, in other examples, the heating material may be other than aluminum. In some examples, the heating material may comprise one or more materials selected from the group consisting of: an electrically-conductive material, a magnetic material, and a magnetic electrically-conductive material. In some examples, the heating material may comprise a metal or a metal alloy. In some examples, the heating material may comprise one or more materials selected from the group consisting of: aluminum, gold, iron, nickel, cobalt, conductive carbon, graphite, steel, plain-carbon steel, mild steel, stainless steel, ferritic stainless steel, molybdenum, silicon carbide, copper, and bronze. Other heating material(s) may be used in other examples.

In certain examples described above, the electrical connecting member extending through the passageway 196 is a heater tail 73. However, examples arrangements described herein for sealing the passageway 196 and/or for providing an advantageous location and orientation for the passageway 196 may also be applied for other types of electrical connecting members. For example, where the apparatus 1 uses inductive heating, a heater tail 73 may supply power to one or more inductor coils and/or one or more temperature sensors arranged inside the housing module 50.

Similarly, certain examples herein have described an electrical connecting member exiting through the passageway 196 which is located away from a distal end and away from a proximal end of the housing module 50. In certain examples described herein, the passageway 196 is provided between first and second housing members 51, 53. However, in examples, the principle described herein of locating the passageway away from the proximal and distal ends of a housing module for allowing the electrical connecting arrangement to exit therefrom may be applied in other examples. For example, in some such examples, the housing module may comprise a single housing member and the passageway may comprise an aperture through the single housing member.

In some examples, the aerosolizable material comprises tobacco. However, in other examples, the aerosolizable material may consist of tobacco, may consist substantially entirely of tobacco, may comprise tobacco and aerosolizable material other than tobacco, may comprise aerosolizable material other than tobacco, or may be free from tobacco. In some examples, the aerosolizable material may comprise a vapor or aerosol forming agent or a humectant, such as glycerol, propylene glycol, triacetin, or diethylene glycol.

In some examples, the aerosolizable material is non-liquid aerosolizable material, and the apparatus is for heating non-liquid aerosolizable material to volatilize at least one component of the aerosolizable material.

In examples, once all, or substantially all, of the volatilizable component(s) of the aerosolizable material in the article 21 has/have been spent, the user may remove the article 21 from the apparatus 1 and dispose of the article 21. The user may subsequently re-use the apparatus 1 with another of the articles 21. However, in other respective examples, the article may be non-consumable, and the apparatus and the article may be disposed of together once the volatilizable component(s) of the aerosolizable material has/have been spent.

In examples described herein the article 21 comprises a mouthpiece assembly 21*b*. However, it will be appreciated that in other examples an example apparatus as described herein may comprise a mouthpiece. For example, the apparatus 1 may comprise a mouthpiece which is integral with the apparatus 1, or in other examples the apparatus may comprise a mouthpiece which is detachably attached to the apparatus 1. In an example, the apparatus 1 may be configured to receive aerosolizable material to be heated. The aerosolizable material may be contained in an article not comprising a mouthpiece portion. A user may draw on the mouthpiece of the apparatus to inhale aerosol generated by the apparatus by heating the aerosolizable material.

In some examples, the article 21 is sold, supplied or otherwise provided separately from the apparatus 1 with which the article 21 is usable. However, in some examples, the apparatus 1 and one or more of the articles 21 may be provided together as a system, such as a kit or an assembly, possibly with additional components, such as cleaning utensils.

In order to address various issues and advance the art, the entirety of this disclosure shows by way of illustration and example various examples in which the claimed invention may be practized and which provide for superior heating elements for use with apparatus for heating aerosolizable material, methods of forming a heating element for use with apparatus for heating aerosolizable material to volatilize at least one component of the aerosolizable material, and systems comprising apparatus for heating aerosolizable material to volatilize at least one component of the aerosolizable material and a heating element heatable by such apparatus. The advantages and features of the disclosure are of a representative sample of examples only, and are not exhaustive and/or exclusive. They are presented only to assist in understanding and teach the claimed and otherwise disclosed features. It is to be understood that advantages, examples, examples, functions, features, structures and/or other aspects of the disclosure are not to be considered limitations on the disclosure as defined by the claims or limitations on equivalents to the claims, and that other examples may be utilized and modifications may be made without departing from the scope and/or spirit of the disclosure. Various examples may suitably comprise, consist of, or consist in essence of, various combinations of the disclosed elements, components, features, parts, steps, 5 means, etc. The disclosure may include other inventions not presently claimed, but which may be claimed in future.

The invention claimed is:

1. A housing module for being received in an aerosol generating device, wherein the housing module is for containing a heater arrangement for heating aerosol generating material in the aerosol generating device, the housing module comprising:

a housing at least partly defining a chamber for containing a heater arrangement for heating aerosol generating material to thereby generate an aerosol, wherein the housing comprises a proximal end and a distal end; and a passageway through the housing into the chamber, wherein the passageway is configured to allow an electrical connecting member for connecting to the heater arrangement to exit the chamber through the passageway;

wherein the passageway is located away from both the proximal end and the distal end of the housing;

wherein the electrical connecting member is configured to exit the housing from a side of the housing;

wherein the housing module comprises a sealing arrangement arranged to seal the passageway while allowing the electrical connecting member through the passageway; and wherein the housing module comprises a first housing member for at least partly defining the chamber for containing a heater arrangement for heating an aerosol generating material; a second housing member attached to the first housing member via an attachment, wherein the first housing member and the second housing member define therebetween the passageway into the chamber, and wherein the passageway is configured to allow the electrical connecting member for connecting to the heater arrangement to extend through the passageway; wherein the attachment between the first housing member and the second housing member is configured to hold the first housing member and the second housing member in a configuration which causes the sealing arrangement to seal the passageway.

2. A housing module according to claim 1 wherein the passageway is oriented laterally to a longitudinal axis of the housing module extending between the proximal and the distal ends of the housing module.

3. A housing module according to claim 1 wherein the passageway is oriented substantially perpendicularly to the longitudinal axis of the housing module.

4. An aerosol generating device comprising:

a housing module according to claim 1; and a heating arrangement arranged in the chamber defined by the housing module; and an electrical connecting member extending through the passageway into the chamber such that a first portion of the electrical connecting member may connect to the heating arrangement;

wherein a second portion of the electrical connecting member is exterior to the housing module and is arranged to connect to an electrical component of the device.

5. An aerosol generating device according to claim 4 wherein the electrical connecting member exits the passageway in a direction lateral to a longitudinal axis of the housing module extending between the proximal and distal ends, and the second portion of the electrical connecting member is aligned substantially parallel to the longitudinal axis of the housing module.

6. An aerosol generating device according to claim 5 wherein the second portion of the electrical connecting member is configured to connect to an electrical component of the device, which is arranged adjacent to the housing module and substantially parallel with a longitudinal axis of the housing module.

7. An aerosol generating device according to claim 5 wherein the electrical connecting member comprises only one bend between a portion of the electrical connecting member which exits the passageway in a direction lateral to the longitudinal axis of the housing module, and the second portion of the electrical connecting member which is aligned substantially parallel to the longitudinal axis of the housing module.

8. An aerosol generating system comprising:

an aerosol generating device according to claim 4; and an article containing an aerosol generating material, wherein the aerosol generating material comprises tobacco and the device is a tobacco heating product.

9. A housing module according to claim 1 wherein the passageway is located between a first end of the first housing member and a second end of the second housing member located adjacent the first end of the first housing member, and the attachment attaches the first end of the first housing member to the second end of the second housing member.

10. A housing module according to claim 1 wherein the attachment between the second housing member and the first housing member is a releasable attachment and/or an attachment which is configurable to allow movement of the second housing member relative to the first housing member to unseal the passageway.

11. A housing module according to claim 10 wherein the attachment comprises one or more threaded attachment members.

12. A housing module according to claim 1 wherein the sealing arrangement comprises a first sealing member and a second sealing member; wherein the attachment between the first housing member and the second housing member is configured to hold the first and second sealing members in abutment with one another to hermetically seal the passageway between the first housing member and the second housing member and wherein the sealing arrangement is arranged in use to allow the electrical connecting member to extend through the passageway between the first sealing member and the second sealing member.

* * * * *